United States Patent [19]

Thornton, Jr. et al.

[11] 4,341,978

[45] Jul. 27, 1982

[54] HIGH-INTENSITY-DISCHARGE LAMP WITH IMPROVED COLOR RENDITION OF ILLUMINATED OBJECTS

[75] Inventors: William A. Thornton, Jr., Cranford; Daniel A. Larson, Cedar Grove, both of N.J.

[73] Assignee: Westinghouse Electric Corp., Pittsburgh, Pa.

[21] Appl. No.: 158,858

[22] Filed: Jun. 12, 1980

[51] Int. Cl.[3] ..... H01J 61/20; H01J 61/44

[52] U.S. Cl. ..... 313/487; 313/229

[58] Field of Search ..... 313/487, 229, 486, 225

[56] References Cited

U.S. PATENT DOCUMENTS 2,103,038 12/1937 Moers ..... 313/225
3,263,111 7/1966 Doering .
3,630,946 12/1971 Ropp et al. ..... 252/301.4 R
3,657,590 4/1972 Johnson ..... 313/223
3,778,662 12/1973 Johnson ..... 313/486 X
4,065,688 12/1977 Thornton ..... 313/487 X

FOREIGN PATENT DOCUMENTS 1488562 6/1967 France .

*Primary Examiner*—Palmer C. Demeo
*Attorney, Agent, or Firm*—W. D. Palmer

[57] ABSTRACT

High-intensity-discharge lamp is fabricated in a fashion generally similar to a standard high-pressure-mercury lamp which has a red-emitting phosphor coated on the outer envelope. In the present lamp, the discharge-sustaining filling in the arc tube is modified to include a small, predetermined proportion of cadmium which adds radiations of a wavelength of about 490 nm to the composite lamp emission. The resulting composite emission has greatly improved color-rendering properties as compared to a similar lamp which does not incorporate the cadmium addition to the arc tube filling.

3 Claims, 1 Drawing Figure

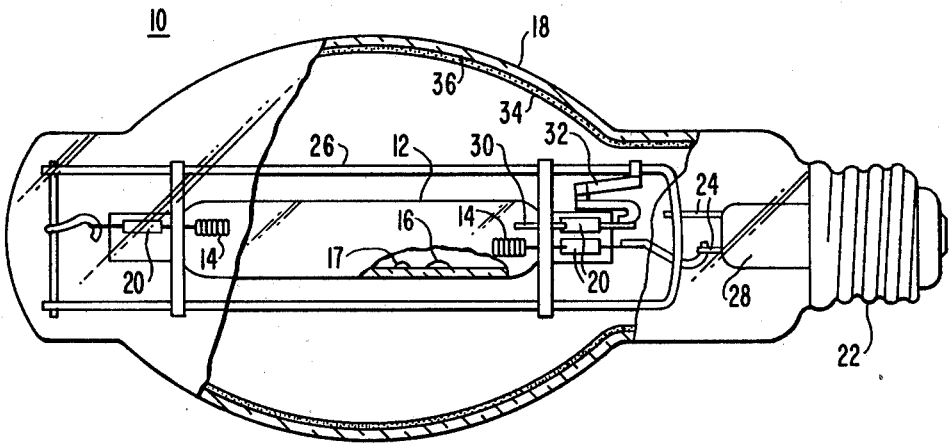
10
18
36
34
32
26
12
30
24
16
14
14
17
20
20
28
22

HIGH-INTENSITY-DISCHARGE LAMP WITH IMPROVED COLOR RENDITION OF ILLUMINATED OBJECTS

CROSS-REFERENCE TO RELATED APPLICATION

In copending application Ser. No. 131,305, filed May 18, 1980, now U.S. Pat. No. 4,315,193 by W. A. Thornton, one of the present applicants, and owned by the present assignee, is disclosed a high-pressure mercury-vapor lamp which incorporates a three-component phosphor coating blend on the outer envelope, in order to provide both improved color rendition and light output. One of the three phosphor components has a narrow-band, blue-violet emission peaked at about 450 nm. The second of the phosphor components has a blue-green emission which is peaked at about 500 nm, and the third phosphor component has an emission which is concentrated at about 620 nm.

BACKGROUND OF THE INVENTION

This invention relates to high-intensity-discharge lamps and, more particularly, to such a lamp which utilizes a special discharge-sustaining filling of predetermined proportions of mercury and cadmium, in addition to a red-emitting phosphor coated on the protective envelope, in order to provide excellent color rendition of illuminated objects.

High-pressure mercury-vapor lamps which have a light emission modified by the use of phosphor mixtures are well-known and one embodiment of such a lamp is described in U.S. Pat. No. 4,065,688, dated Dec. 27, 1977 to W. A. Thornton, the present applicant. The phosphors utilized include red-emitting yttrium vanadate or yytrium phosphate vanadate activated by trivalent europium. Another embodiment of such a lamp is described in U.S. Pat. No. 3,602,758, dated Aug. 31, 1971 to Thornton et al.

A method for preparing red-emitting yytrium vanadate phosphor activated by trivalent europium is disclosed in U.S. Pat. No. 3,630,946, dated Dec. 28, 1971 to Ropp et al and such phosphor is now well known.

It is known to use cadmium vapor as a discharge-sustaining medium in a fluorescent lamp, as taught in French Pat. No. 1,488,562 Del. Date June 5, 1967.

Cadmium-mercury amalgams have been used as discharge-sustaining medium in highly loaded fluorescent lamps, as disclosed in U.S. Pat. No. 3,263,111, dated July 26, 1966.

Cadmium has been used as the discharge-sustaining constituent in high-intensity discharge lamps, as disclosed in U.S. Pat. No. 3,657,590, dated Apr. 18, 1972.

SUMMARY OF THE INVENTION

There is provided a high-intensity-discharge lamp which is intended for operation at a predetermined wattage and which comprises a sealed, elongated, radiation-transmitting arc tube having electrodes operatively disposed therein proximate the ends thereof. A sealed light-transmitting protective envelope has the arc tube operatively mounted therein, with the environment enclosed by the protective envelope being non-reactive for the lamp elements enclosed thereby. Electrical lead-in means are sealed throuh the arc tube and connect to the electrodes and electrical adaptor means is affixed to the outer surface of the protective envelope to facilitate electrical connection to a source of electrical power.

Electrical conductor means electrically connect the electrical adaptor means to the electrical lead-in means. The arc tube encloses discharge-sustaining constituents plus a small charge of inert ionizable ionizing gas. The principal discharge-sustaining constituent in the arc tube is mercury which is present in predetermined amount to provide a predetermined voltage drop between the lamp electrodes when the lamp is operating at its rated wattage input. Cadmium is included within the arc tube as a supplemental discharge-sustaining constituent, and the weight ratio of the mercury constituent to the cadmium constituent in the arc tube is from about 50:1.5 to about 50:0.2. A predetermined amount of finely divided phosphor means is carried as a coating on the inner surface of the protective envelope and the phosphor means principally comprises trivalent-europium-activated phosphor having a strong red emission at about 620 nm.

BRIEF DESCRIPTION OF THE DRAWING

For a better understanding of the invention, reference may be had to the preferred embodiment, exemplary of the invention, shown in the sole FIGURE of the drawing which is an elevational view, partly in section, illustrating a high-intensity-discharge lamp fabricated in accordance with the present invention.

DESCRIPTION OF THE PREFERRED EMBODIMENTS

With specific reference to the form of the invention illustrated in the drawing, the high-intensity-discharge lamp 10 is designed to operate with a power input of 400 watts and comprises a sealed, elongated, radiation-transmitting arc tube 12 which is fabricated of quartz having electrodes 14 operatively disposed therein proximate the ends thereof. The arc tube encloses a discharge-sustaining filling plus a small charge of inert, ionizable starting gas such as 20 torrs of argon. In accordance with the present invention, the principal discharge-sustaining constituent in the arc tube is mercury 16 present in predetermined amount to provide a predetermined voltage drop between the electrodes 14 when the lamp is operated at its rated wattage input. A small charge of cadmium 17 is also included within the arc tube 12 as a supplemental discharge-sustaining constituent, and the weight ratio of the mercury constituent to the cadmium constituent in the arc tube is from about 50:1.5 to about 50:0.2.

As a specific example, for a 400 watt size arc tube 12 designed to have a potential drop of 130 volts between the electrodes 14 when the lamp is operating at its rated wattage input, approximately 50 mg of mercury are included in the arc tube as the principal discharge-sustaining constituent, and cadmium is included within the arc tube in amount of from about 1.5 milligram to about 0.2 milligram. As a specific example, cadmium is included in amount of about 0.5 milligram.

The arc tube 12 is operatively mounted in a sealed, light-transmitting, protective vitreous envelope 18 and the environment enclosed by the envelope 18 is non-reactive for the lamp elements which are enclosed thereby, an example being a nitrogen atmosphere. Electrical lead-in means are sealed through the arc tube and connect to the electrodes and the lead-in means include conventional molybdenum ribbon seals 20 which are used to provide the hermetic seal. An electrical adaptor means such as a conventional screw-type base 22 is affixed to the outer surface of the protective envelope 18 to facilitate electrical connection to a source of power. Electrical conductor means 24 connect the base 22 to the electrical lead-in means 20. To complete the description, the arc tube is supported by a conventional frame 26 which forms a part of one of the electrical conductor means 24 which are sealed for passage through the protective outer envelope 18 by means of a conventional stem press 28. The arc tube is provided with a conventional starting electrode 30 which connects through a resistor 32 to the oppositely disposed electrode 14. During operation of the lamp, the vaporized mercury provides radiations which principally comprise a very strong green emission, a very strong yellow emission, a strong violet emission, and both short wavelength and long wavelength ultraviolet emissions. The cadmium addition to the discharge provides a strong blue-green emission centered at about 490 nm.

A layer 34 of phosphor means is coated on the interior surface 36 of the outer envelope 18. This phosphor is trivalent-europium-activated phosphor which has a strong red emission located at about 620 nm. As a specific example, the phosphor is coated in amount of 2.5 mg/cm. The preferred red-emitting phosphor is yttrium vanadate activated by trivalent europium and such phosphor is described in detail in the aforementioned U.S. Pat. No. 630,946.

The relatively small addition of cadmium as a discharge-sustaining constituent adds a strong emission at about 490 nm and this substantially increases the color rendering index of the composite lamp emission from about 45 to a value of from 60 to 90, depending on the amount of cadmium addition, and color rendering indexes having a value of about 80 are readily obtainable. In test lamps the amount of cadmium supplemental discharge-sustaining constituent was varied to measure the effects of the cadmium addition. When the weight ratio of mercury to cadmium is about 50:1, the measured lamp efficacy is decreased by about 16%, but the color rendering index of the composite lamp emission is improved from 45 to a value in the range of from 80 to 90. With a mercury to cadmium weight ratio of about 50:0.3, the efficacy is only very slightly decreased, while still obtaining a substantial improvement in color rendering index. In order to maintain a reasonably high efficacy, the cadmium addition should not exceed about 1.5 mg for the specific lamp as described. Also, in order to insure that sufficient cadmium will be present during prolonged lamp operation, the cadmium addition should not be less than about 0.2 mg for the specific lamp as described. Thus, the weight ratio of mercury to cadmium in the arc tube should be from about 50:1.5 to about 50:0.2.

The source color or appearance of the composite lamp emission can be readily varied by altering the mercury to cadmium ratio as well as by altering the amount of vanadate phosphor which is utilized. As an alternative embodiment, the source color of the composite lamp emission can be made cooler by adding to the phosphor coating 34 a small predetermined proportion of divalent-europium-activated phosphor which has a narrow-band, blue-violet emission peaked at about 450 nm. Such a phosphor is apatite-structured strontium chlorophosphate activated by a divalent europium and is disclosed in U.S. Pat. No. 4,038,204, dated July 26, 1977. Other such blue-violet-emitting phosphors activated by divalent europium are known and are described in U.S. Pat. No. 2,937,998, dated Feb. 10, 1976. As a specific example, in order to increase the color temperature of the composite lamp emission, 15% by weight of the trivalent-europium-activated yttrium vanadate is replaced by an equivalent weight of the apatite-structured strontium chlorophosphate activated by divalent europium.

We claim:

1. A high-intensity-discharge lamp intended for operation at a predetermined wattage input and comprising:

a sealed elongated radiation-transmitting arc tube having electrodes operatively disposed therein proximate the ends thereof, a sealed light-transmitting protective envelope in which said arc tube is operatively mounted with the environment enclosed by said protective envelope being non-reactive for the lamp elements enclosed thereby, electrical lead-in means sealed through said arc tube and connecting to said electrodes, electrical adaptor means affixed to the outer surface of said protective envelope to facilitate electrical connection to a source of electrical power, and electrical conductor means electrically connecting said electrical adaptor means to said electrical lead-in means, said arc tube enclosing discharge-sustaining constituents plus a small charge of inert ionizable starting gas, the principal discharge-sustaining constituent in said arc tube being mercury present in predetermined amount to provide a predetermined voltage drop between said electrodes when said lamp is operating at said rated wattage input, and cadmium included within said arc tube as a supplemental discharge-sustaining constituent, and the weight ratio of said mercury constituent to said cadmium constituent in said arc tube being from about 50:1.5 to about 50:0.2; and a predetermined amount of finely divided phosphor means carried as a coating on the inner surface of said protective envelope, said phosphor means principally comprising trivalent-europium-activated phosphor having a strong red emission located at about 620 nm.

2. The lamp as specified in claim 1, wherein said phosphor means also includes a predetermined proportion of divalent-europium activated phosphor having a narrow band blue-violet emission peaked at about 450 nm.

3. The lamp as specified in claims 1 or 2, wherein said red-emitting phosphor is trivalent-europium activated yttrium vanadate.

* * * * *